US005381738A

United States Patent [19]

Meyer

[11] Patent Number: 5,381,738

[45] Date of Patent: Jan. 17, 1995

[54] ADJUSTABLE WORK TABLE ASSEMBLY

[76] Inventor: Klaus Meyer, 228 Crossett St., Syracuse, N.Y. 13207

[21] Appl. No.: 92,909

[22] Filed: Jul. 19, 1993

[51] Int. Cl.[6] ..... A47B 23/00

[52] U.S. Cl. ..... 108/42; 108/108; 108/152

[58] Field of Search ..... 108/42, 47, 48, 108, 108/152, 144, 134, 138, 115; 248/243, 244, 245; 211/162, 208; 52/27, 29

[56] References Cited

U.S. PATENT DOCUMENTS

| | | | |
|---|---|---|---|
| 432,901 | 7/1890 | Roos | 108/42 X |
| 624,115 | 5/1899 | Steele . | |
| 3,026,158 | 3/1962 | Freeman . | |
| 3,854,686 | 12/1974 | Konstant | 108/108 X |
| 4,040,588 | 8/1977 | Papsco et al. | 108/108 X |
| 4,129,198 | 12/1978 | Hunter | 108/152 X |
| 4,605,131 | 8/1986 | Debus . | |
| 4,791,873 | 12/1988 | Towfigh | 108/10 |
| 4,901,965 | 2/1990 | Bowman | 108/108 X |
| 4,924,972 | 5/1990 | Westbrock | 108/152 X |
| 4,998,484 | 3/1991 | Groetzinger | 108/42 |

FOREIGN PATENT DOCUMENTS

| | | | |
|---|---|---|---|
| 211211 | 11/1957 | Australia | 248/244 |
| 593273 | 2/1934 | Germany | 248/244 |

*Primary Examiner*—Jose V. Chen

*Attorney, Agent, or Firm*—Katherine McGuire

[57] ABSTRACT

An adjustable table assembly comprising a planar work surface which is pivotally secured at the rear edge thereof to a pair of parallel, laterally spaced, vertical support members such that the work surface can be moved substantially continuously between a fully horizontal, extended position and a fully vertical, retracted position. Unique brackets attach the rear ends of upper and lower linkage bars to the support members with the brackets and support members being configured for cooperative, mating engagement whereby the brackets are adjustably longitudinally slidable upon the support members. The forward brackets attaching the forward ends of the lower linkage bars to the upper linkage bars are also configured for adjustable, longitudinal sliding engagement therewith.

13 Claims, 5 Drawing Sheets

FIG-2
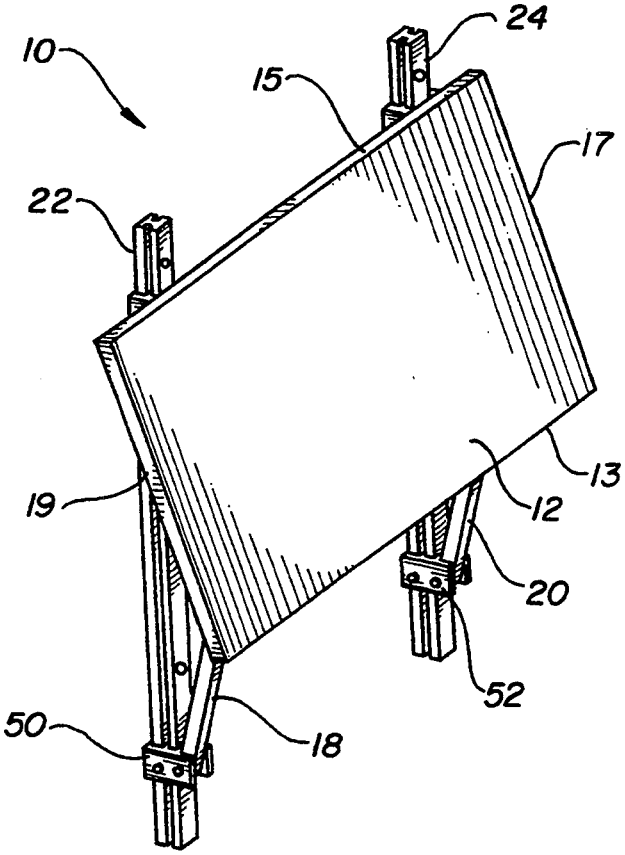
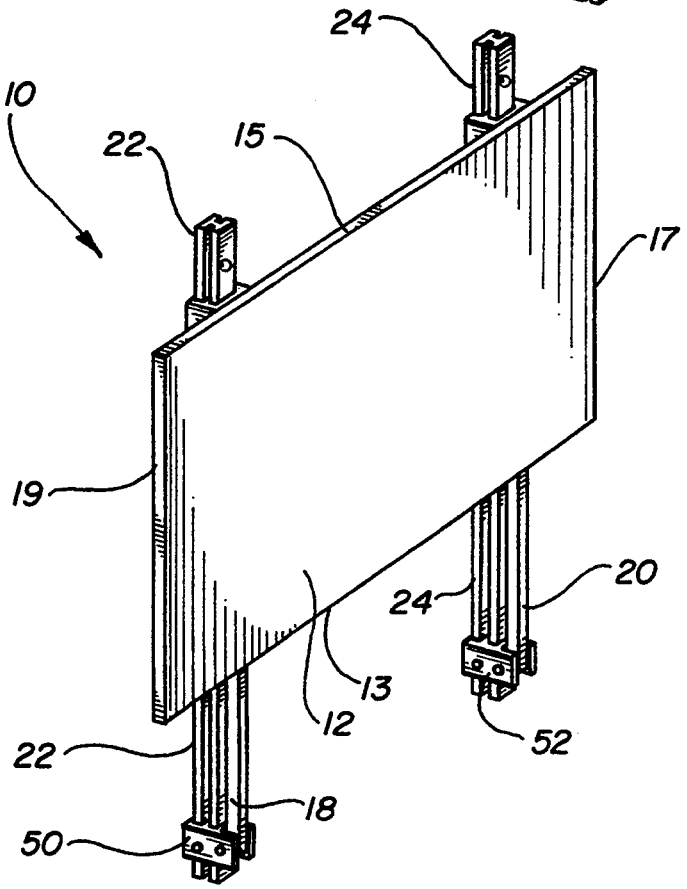
FIG-3

ADJUSTABLE WORK TABLE ASSEMBLY

BACKGROUND OF THE INVENTION

The present invention relates to adjustable work table assemblies and, more particularly, to an adjustable work table assembly which is pivotally attached to a pair of wall mounted, vertically oriented support members. The work surface is further selectively vertically adjustable upon the support members.

The need and desirability of a multi-purpose, adjustable work table assembly whose various uses include a storage shelf, drafting table, or eating surface, for example, may be gathered from the variety of such structures presently available. These structures are typically wall mounted and offer a planar surface which may be moved in a continuously adjustable manner between a fully extended, horizontal position, and a fully retracted, vertical position with some people preferring the work surface to be tilted at an angle. When not in use, the work surface may be moved to the retracted, vertical position thereby giving more useful space to the room in which the work surface is located. Desirable features of these types of structures include stability and ease of adjustability.

One such structure may be seen in U.S. Pat. No. 4,791,873 issued to Towfigh on Dec. 20, 1988. The Towfigh patent discloses an adjustable work surface which is pivotally attached via linkages to a pair of vertical standards mounted to a wall. The vertical standards include a rear wall 18, a pair of side walls 20 and a pair of inwardly extending flanges 22, the inner edges of which define a longitudinally extending slot. Upper and lower linkages are provided with the upper linkages being directly attached to the bottom surface of the work surface, with first ends of each pair of the upper and lower linkages attached together at a common pivot 38. The rear ends of the linkages pivotally attach to respective yokes which are slidably engaged within the longitudinal channel of the respective standard. The yokes may be secured in the desired, vertical position with set screws 54 and 60 on the bottom and top yokes, respectively. Additionally, downward movement of the work surface is limited by a stop formed by a shoulder 62 in the lower linkage against which the top linkage rests when in the horizontal position.

While the Towfigh desk-top is similar in function to the present invention, it does not provide for adjustability of the position of the front end of the lower linkage to the upper linkage. This feature, as provided in the present invention, allows adjustability of the point of support for the work surface which may need to be changed according to the weight and position of a load placed upon the work surface. Furthermore, it is believed that the set screws of Towfigh do not provide adequate securement of the yokes within the standards and may fail to support the work surface under a heavy load. Lastly, the lower set screws require a separate tool to loosen and tighten, and all set screws require strength from the individual, thereby posing a difficulty for a disabled person.

Other types of adjustable folding work surfaces may be seen in the following U.S. patents:

No. 4,998,484 issued to Groetzinger on Mar. 12, 1991 which shows a slide slot 52 formed in the slide channel 50 through which a rod 70 extends movement of the upper support channel 40 therein. Adjustable bracket means are shown in FIG. 8 thereof.

No. 4,605,131 issued to Debus et al on Aug. 12, 1986.

No. 624,115 issued to Steele on May 2, 1899.

No. 3,026,158 issued to Freeman on March 20, 1962.

SUMMARY OF THE INVENTION

It is a principal object of the present invention to provide an adjustable work surface which is very sturdy and can support a considerable load when locked into one of many desired, operative positions.

It is a further object of the present invention to provide a wall mounted, adjustable work surface which may be easily and quickly moved between a fully horizontal, operative position and a fully vertical, stored position.

It is another object of the present invention to provide an adjustable work surface of the above type which is of simple construction and easy to use, yet provides linkage connections which are very secure.

Other objects will in part be obvious and in part appear hereinafter.

In accordance with the foregoing objects, the invention comprises an adjustable planar work surface which is slidably and pivotally attached to a pair of wall mounted, vertically oriented support members via two pairs of upper and lower linkage bars. The work surface is directly attached in covering relation to the pair of upper linkage bars and is movable therewith. The rear ends of the upper and lower linkage bars are each pivotally attached to a respective bracket which slidably engages a respective support member. The forward ends of the pair of lower linkage bars are pivotally attached to a respective pair of brackets which are slidably engaged to the upper linkages and movable therealong from the forward to rear ends thereof, respectively.

The vertical support members are of generally I-shaped cross-section having rear and front walls lying in spaced, parallel planes to each other. A third wall extends perpendicularly between and interconnects the front and rear walls to define first and second, opposite side channels which traverse along either side of the entire length of a respective support member. The support members are mounted to a wall surface with the rear walls thereof lying flatly thereagainst. The support members are vertically oriented in parallel, laterally spaced relationship to each other.

The brackets which connect the rear ends of the upper and lower linkage bars to the support members are configured for sliding, meshing engagement with a respective support member. The brackets are of generally rectangular block form having rear and front slotted portions with the rear slotted portion having inwardly extending, diametrically opposite flanges which may be placed in meshing engagement with the opposite side channels of a respective support member. An aperture extending laterally through the rear slotted portion of the bracket may be aligned with any one of a plurality of longitudinally spaced apertures formed in the support members such that the brackets carrying the upper and lower linkage bars are vertically adjustable upon the support members via a bolt removably extending through the aligned apertures in the bracket and support member.

The upper linkage bars are of rectangular cross-section and include a plurality of longitudinally spaced bore holes formed therethrough. The brackets which are pivotally attached to the forward ends of the upper linkage bars also include laterally aligned bore holes which may be placed in alignment with any one of the apertures in a respective upper linkage bar whereby the brackets are slidingly adjustable thereon from the forward to rear ends thereof.

BRIEF DESCRIPTION OF THE DRAWINGS

FIG. 2 is a perspective view of the adjustable work surface showing the work surface in a tilted position between the horizontal and vertical positions;

FIG. 3 is the view of FIG. 2 showing the work surface in the fully retracted, vertical position;

DETAILED DESCRIPTION

Figure 1:
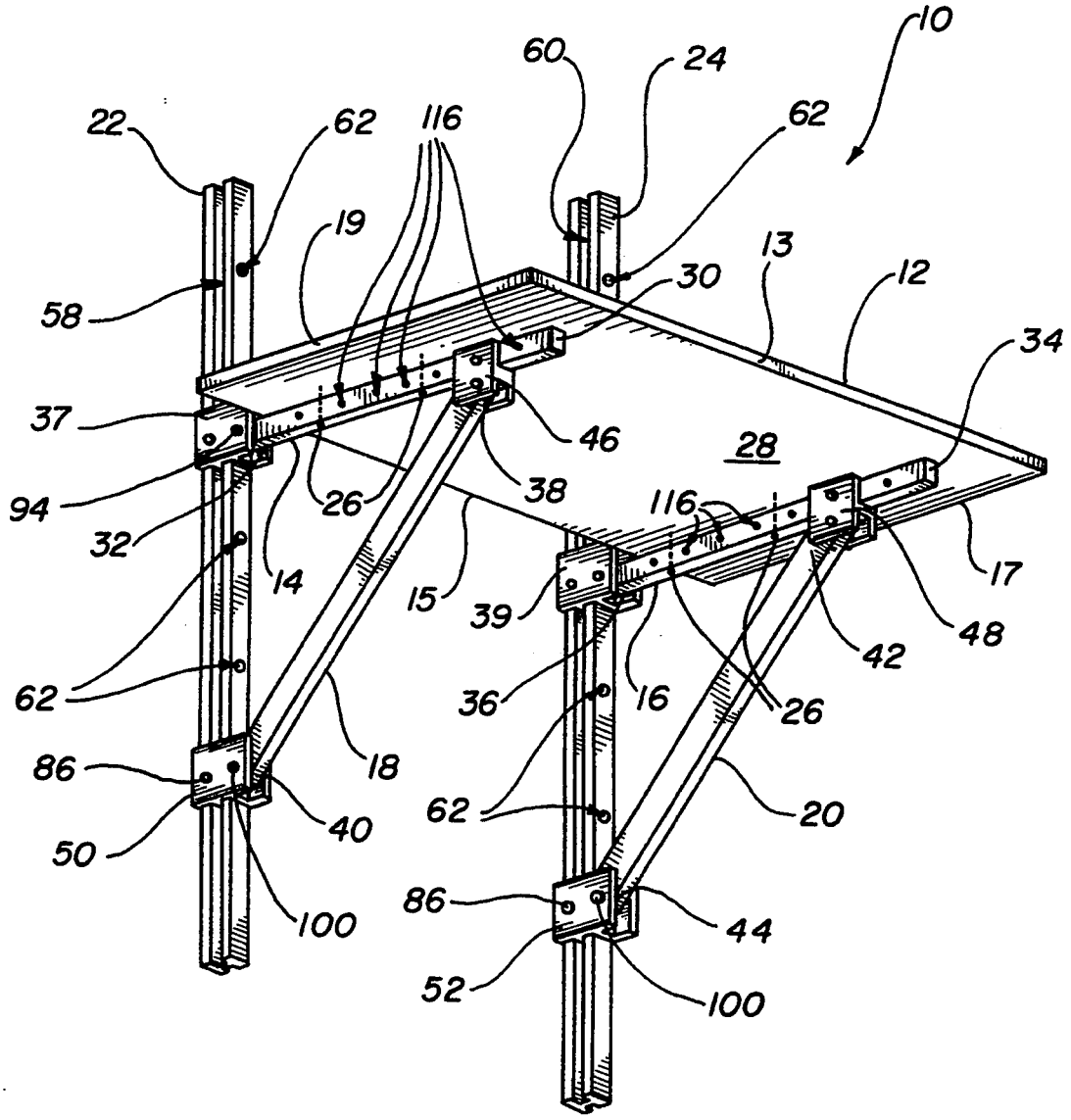
FIG. 1 is a perspective view of the adjustable work surface attached to a pair of vertically oriented support members showing the work surface in the fully extended, horizontal position.

Referring now to the drawings, there is seen in FIGS. 1–4 a preferred embodiment of the adjustable work table assembly denoted generally by the reference numeral 10. Briefly, assembly 10 comprises a rigid, rectangular, planar work surface 12; first and second upper linkage bars 14 and 16, first and second lower linkage bars 18 and 20; and first and second, elongated support members 22 and 24. Work surface 12 includes front and rear edges 13 and 15, respectively, and opposite side edges 17 and 19, and is fixedly secured to upper linkage bars 14 and 16 via mounting screws 26 threaded through bars 14 and 16 and extending into the bottom surface 28 of work surface 12. Upper linkage bars 14 and 16 include forward and rear ends 30, 32 and 34, 36, respectively, and are positioned parallel and adjacent opposite side edges 19 and 17 of work surface 12, respectively. The forward ends 30 and 34 of upper linkage bars 14 and 16 are positioned adjacent forward edge 13 of surface 12, with rear ends 32 and 36 thereof extending slightly rearwardly past rear edge 15 of surface 12 and attaching to support members 22 and 24 via first and second upper brackets 37 and 39, respectively, discussed in greater detail below.

Lower linkage bars 18 and 20 include forward and rear ends 38, 40 and 42, 44, respectively, with the forwards ends 38 and 42 thereof being attached to upper linkage bars 14 and 16 via third and forward brackets 46 and 48, respectively. The rear ends 40 and 44 of lower linkage bars 18 and 20 attach to support members 22 and 24 via first and second lower brackets 50 and 52, respectively.

Figure 6:
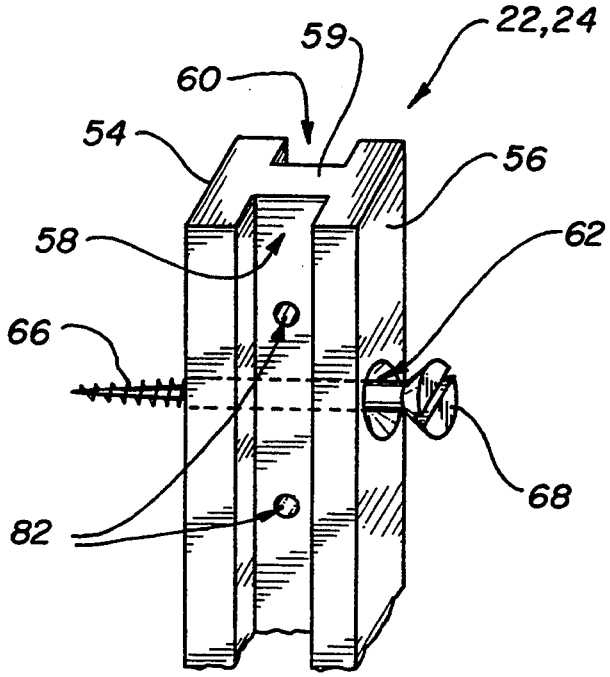
FIG. 6 is a perspective, broken away view of a support member and mounting screw.

As seen best in FIG. 6, support members 22 and 24 are of I-shaped cross-section and include rear and front walls 54 and 56, respectively, which lie in spaced, parallel planes to each other. A third wall 59 extends perpendicularly between and integrally interconnects rear and front walls 54 and 56 to define first and second, opposite, parallel side channels 58 and 60, respectively, which traverse along either side of the entire length of a respective support member 22, 24.

A first plurality of bore holes 62 are formed in longitudinally spaced relation along each support member 22, 24, extending entirely therethrough from the front to rear walls 56, 54 thereof, and through the third, interconnecting wall 59. With rear wall 54 placed flatly against a vertical wall surface 64, a respective plurality of screws 66 (FIG. 6) are inserted through the first plurality of bore holes 62 and into the wall surface 64 thereby securely mounting support members 22, 24 to the wall surface 64. Preferably, the bore hole opening at the front wall 56 of the standard 22, 24 is countersunk such that the head 68 of the screw 66 lies substantially flush therewith when fully inserted through the bore hole 62.

Figure 7:
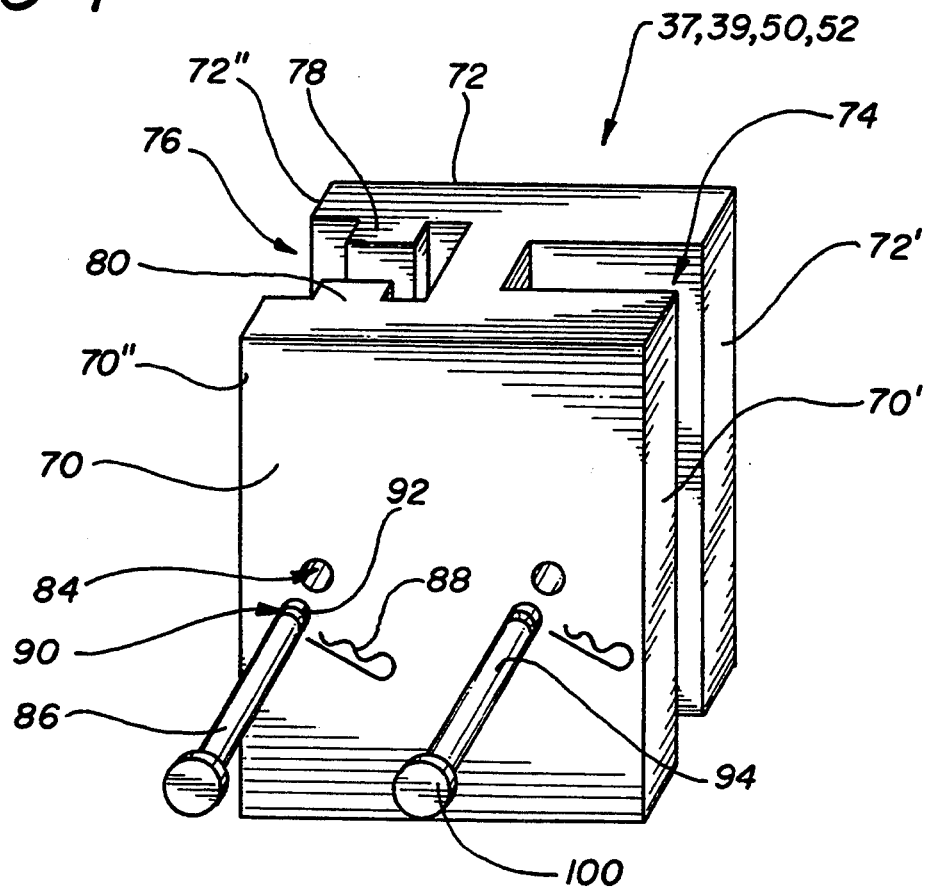
FIG. 7 is a perspective view of the mounting bracket as seen in FIGS. 1–5, and showing a pair of removable bolts with respective cotter-type pins in spaced relation to a respective pair of bore holes formed in the bracket.

The upper and lower brackets 37, 39 and 50, 52, respectively, which attach the rear ends 32, 36 and 40, 44 of the upper and lower linkage bars 14, 16 and 18, 20, respectively, to the support members 22 and 24, are configured for sliding, meshing engagement with a respective support member. As seen best in FIGS. 5 and 7, brackets 37, 39, 50 and 52 are identical, being of generally rectangular block form having first and second side walls 70, 72 which lie spaced and parallel to each other; a longitudinal front slot 74 extending between the forward-most portions 70′ and 72′ of the first and second side walls 70 and 72; and a longitudinal rear slot 76 extending between the rear-most portions 70″ and 72″ of the side walls 70 and 72. First and second, diametrically opposite, parallel flanges 78 and 80 of rectangular cross-section longitudinally traverse the inwardly facing surfaces of the rear-most portions 70″ and 72″ of the side walls 70 and 72 in the rear slot 76 such that the rear slot 76 is of generally I-shaped cross-section.

The respective I-shaped cross-section configuration of the support members 22, 24 allows for the meshing mating engagement of the bracket 37, 39, 50 and 52 with its respective support member 22, 24 by inserting the rear slot 76 of a respective bracket over a free end of a respective support member. The preferred manufacturing materials of the members 22, 24 and brackets 37, 39, 50 and 52 provide a low coefficient of friction therebetween thereby facilitating sliding movement of the bracket 37, 39, 50 and 52 upon a respective support member 22, 24. Means are provided for selectively adjusting the position of the brackets 37, 39, 50 and 52 upon its respective support member 22, 24. Specifically, a second plurality of longitudinally spaced bore holes 82 are formed through the interconnecting wall 59 of each support member 22, 24 in a direction parallel to the forward and rear walls 54 and 56 thereof, respectively. A first bore hole 84 is formed in the bracket 37, 39, 50 and 52 through the side wall portions 70″ and 72″ and flanges 78 and 80 in a direction perpendicular to the side walls 70 and 72. The bracket 37, 39, 50 and 52 is mounted upon a respective support member 22, 24 with the diametrically opposite flanges 78, 80 of the former in meshing, mating engagement with the diametrically opposite slots 58 and 60 of the latter. In this position, the bore hole 84 in the rear portion of the bracket 37, 39, 50 and 52 may be aligned with any one of the second plurality of bore holes 82 in a respective support member 22, 24. In this regard, a bolt 86 is provided which may be removably inserted through aligned bore holes 84 and 82 as seen best in FIG. 5, and secured therein by a removable cotter pin 88 engaging a circular notch 90 in the end 92 of bolt 86 extending exteriorly of bracket 37. Thus, each bracket 37, 50 and 39, 52 may be individually vertically adjusted along substantially the entire lengths of support members 22 and 24 as desired, respectively, by simple removal and reinsertion of a respective bolt 86 through aligned holes 82 and 84 in the support member 22, 24 and bracket 37, 50 and 39, 52, respectively.

It may be readily realized that the upper brackets 37 and 39 attaching the upper linkage bars 14 and 16 to the support members 22, 24, respectively, should always be in horizontal alignment upon members 22 and 24. Likewise, lower brackets 50 and 52 attaching the lower linkage bars 18 and 20 to the support members 22 and 24 should always be in horizontal alignment with each other thereby maintaining the forward and rear edges 13 and 15 of surface 12 substantially horizontal as surface 12 is moved between the fully extended, horizontal position seen in FIGS. 1 and 4, and the tilted and fully retracted, vertical position seen in FIGS. 2 and 3, respectively.

Figure 5:
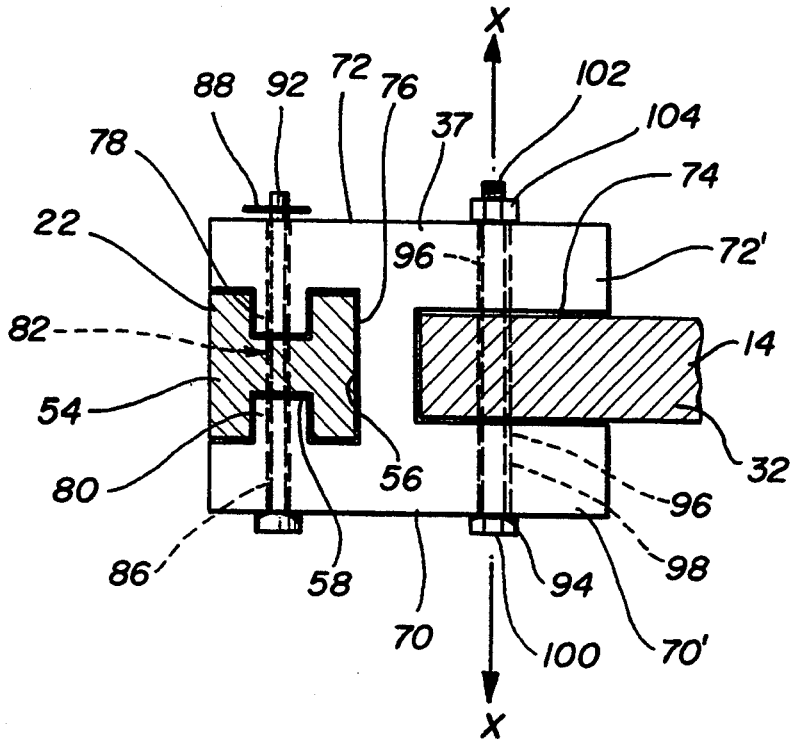
FIG. 5 is a cross-sectional view of a support member as taken along the line 5—5 in FIG. 4 and showing a mounting bracket in meshing engagement therewith, a portion of the upper linkage bar (broken away) Shown pivotally attached to the mounting bracket.

The upper and lower linkage bars 14, 16 and 18, 20 are pivotally attached at the respective rear ends 32, 36 and 40, 44 thereof to upper and lower brackets 37, 39 and 50, 52, respectively. In particular, attention is turned to FIG. 5 which shows rear end 32 of upper bracket 14 pivotally attached to bracket 37 inside the forward slot 74 thereof by a bolt 94 removably inserted through aligned bore holes 96 and 98 formed laterally through the forward walls 70', 72' of bracket 37 and rear end 32 of upper linkage bar 14, respectively. Although FIG. 5 is shown and described with reference to a single bracket 37 in association with upper linkage bar 14, it is understood that the configuration and attachment method thereof is the same for each bracket 37, 39, 50 and 52 and its respective upper and lower linkage bar attached to support members 22, 24.

Bolt 94 has a head portion 100 which abuts forward wall 70' of bracket 37, and an opposite, threaded end 102 which extends exteriorly of bracket forward wall 72' when bolt 94 is fully inserted through bore holes 96 and 98. A nut 104 is provided which removably threadedly engages end 102 thereby firmly securing upper linkage bar rear end 32 within bracket slot 74. Upper linkage bar 14 may thus pivot about an axis x—x extending through bolt 94 and, thus, every other linkage bar rear end 36, 40 and 44 may pivot about a similar axis extending in directions parallel to axis x—x through their respective bolt attachments. This of course permits the work surface 12 to be moved between the horizontal, tilted and vertical positions seen in FIGS. 1–3, respectively, as lower brackets 50 and 52 are slid downwardly (and/or upper brackets 37 and 39 are slid upwardly) along support members 22 and 24.

Figure 8:
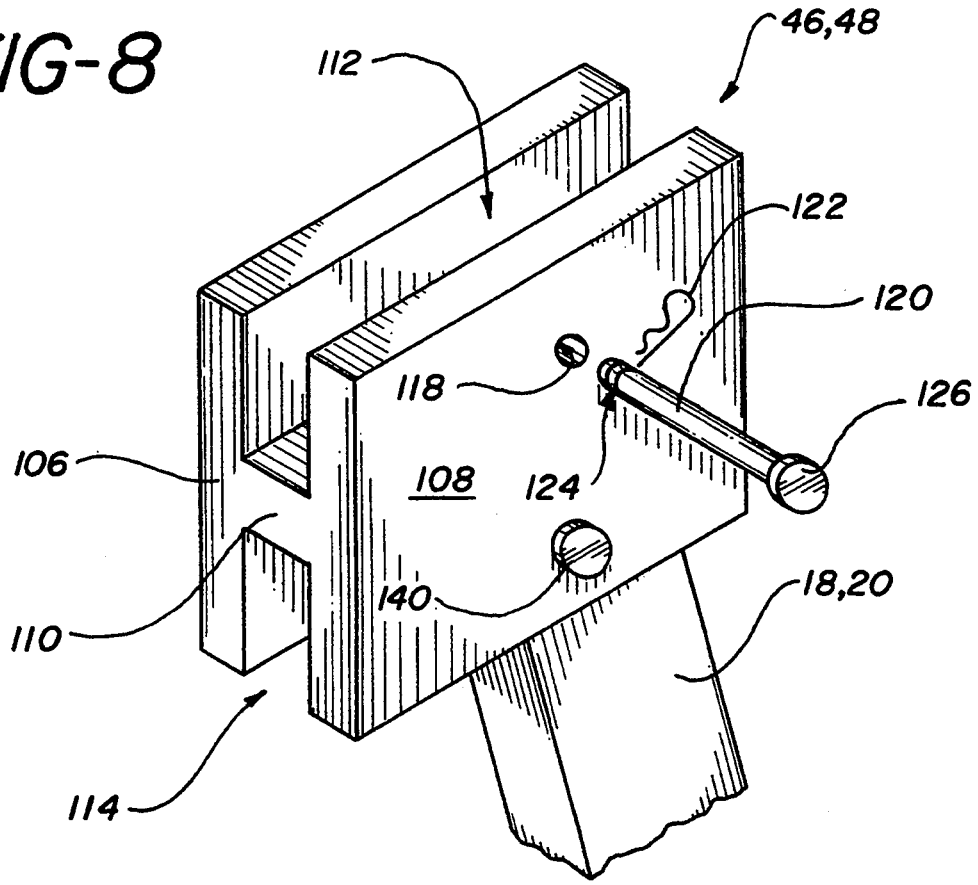
FIG. 8 is a perspective view of the forward mounting bracket which attaches the forward end of the lower linkage bar (shown broken away) to the upper linkage bar via a removable bolt shown in spaced relation thereto.
Figure 9:
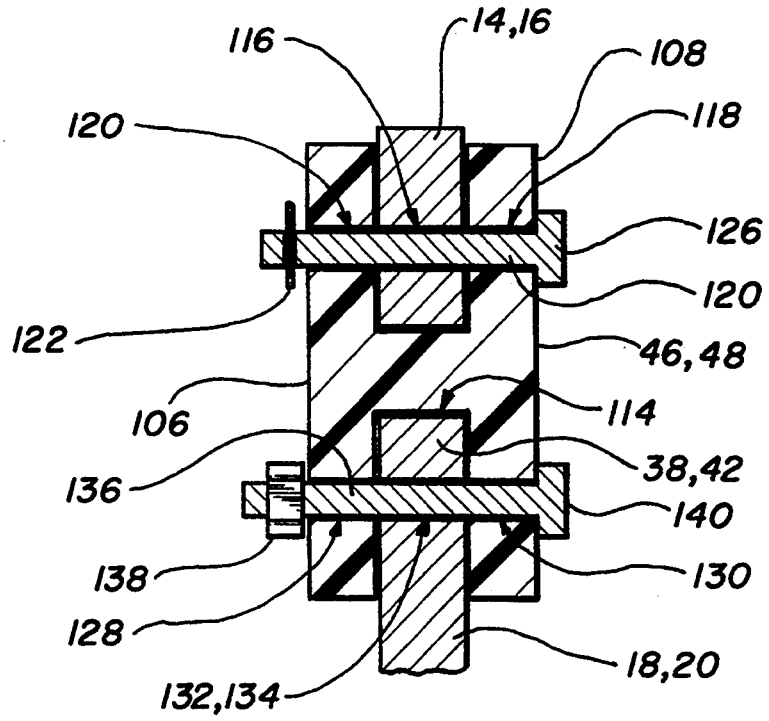
FIG. 9 is a cross-sectional view thereof as taken along the line 9—9 in FIG. 4.

Attention is turned to FIGS. 8 and 9 which show the forward brackets 46, 48 attaching the forward ends 38, 42 of lower linkage bars 18, 20 to upper linkage bars 14, 16, respectively. Again, the configuration and attachment means of both forward brackets 46, 48 and the lower and upper linkage bars 18, 20 and 14, 16 attachment thereto, respectively, are identical. Forward brackets 46, 48 are seen to be also of generally rectangular outline and have an I-shaped cross-section. Specifically, a pair of spaced apart, parallel walls 106 and 108 are connected by a middle wall 110 integrally extending perpendicularly therebetween defining upper and lower, diametrically opposite slots 112 and 114, respectively.

Figure 4:
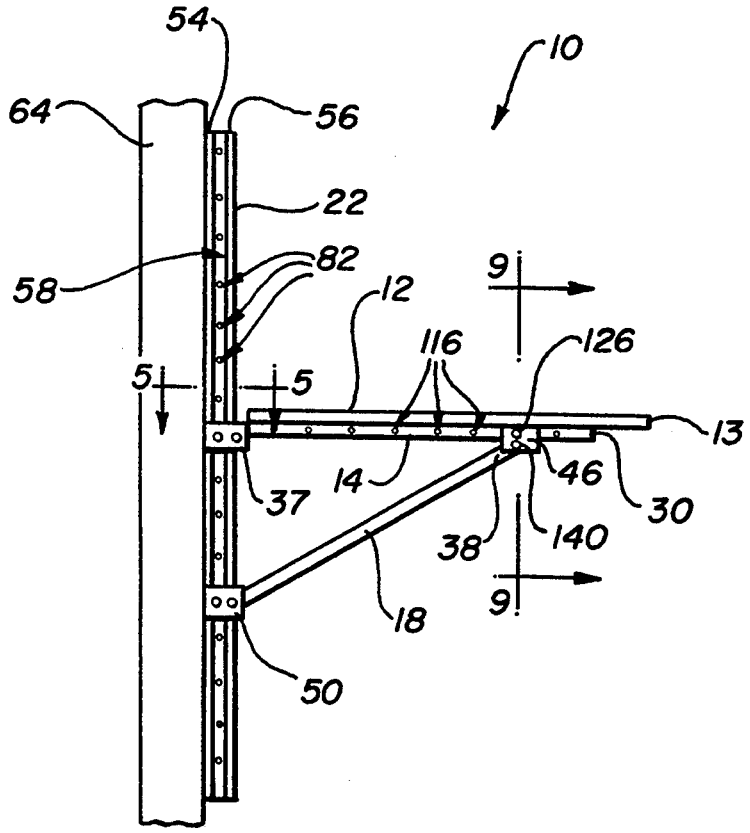
FIG. 4 is a side, elevational view showing the support members mounted to a wall and the work surface in its fully extended, horizontal position.

As seen in FIGS. 1 and 4, upper linkage bars 14 and 16 include a plurality of bore holes 116 longitudinally spaced along substantially the entire lengths thereof, bore holes 116 extending in a direction parallel to the forward and rear edges of the planar work surface 12. As seen best in FIGS. 8 and 9, forward brackets 46, 48 include laterally aligned, upper bore holes 118, 120 formed through walls 106 and 108 at upper slot 112. Slot 112 is of generally rectangular outline having cross-dimensions slightly larger than the respective cross-dimensions of upper linkage bars 14, 16. Upper brackets 46 and 48 may thus be removably attached to upper linkage bars 14 and 16, respectively by positioning upper slot 112 of upper bracket 46, 48 over a respective upper linkage bar 14, 16, and laterally aligning bore holes 118, 120 of the bracket 46, 48 with any one of the plurality of bore holes 116 of its respective upper linkage bar 14, 16. A bolt 120 may then be removably inserted consecutively through bore holes 118, 116 and 120 and secured therein with a cotter pin 122, or the like, frictionally engaging circular notch 124 formed at the end of bolt 120 opposite head 126. It will thus be appreciated that upper brackets 46, 48 may be easily moved linearly along respective upper linkage bars 14, 16 by removing and re-inserting bolt 120 through upper bore holes 118, 120 in forward brackets 46, 48, and any one of the bore holes 116 formed in upper linkage bars 14, 16, respectively.

The forward ends 38, 42 of lower linkage bars 18, 20 are attached to forward brackets 46, 48 in a similar manner. Specifically, forward brackets 46, 48 include a second set of laterally aligned, lower bore holes 128 and 130 formed through walls 106, 108 at lower slot 114 (FIG. 9). Forward ends 38, 42 of lower linkage bars 18, 20 also each include a bore hole 132, 134, respectively, which are aligned with bore holes 128, 130 in lower slot 114 of forward bracket 46, 48, respectively. A bolt 136 is inserted through bore aligned holes 128, (132,134), and 130 and is secured therein by a nut 138 threadedly attached to the end thereof extending exteriorly of wall 106, opposite head portion 140. Lower linkage bar ends 38, 42 are thereby pivotally attached to forward brackets 46, 48, respectively, and may pivot about an axis extending linearly through respective bolts 136. As such, as lower brackets 50, 52 are moved downwardly along support members 22, 24 as seen in FIGS. 1–3, lower linkage bars 18, 20 pivot about their respective attachment points to lower brackets 50, 52 and forward brackets 46, 48, to assume positions at an angle to support members 22, 24 (FIGS. 1, 2 and 4), and substantially vertical and closely adjacent support members 22, 24, respectively (FIG. 3). This same movement may of course be accomplished by moving either or both of lower and upper brackets 50, 52 and 37, 39 downwardly and upwardly along support members 22, 24, respectively.

It will usually be preferred that forward brackets 46, 48 be positioned somewhat adjacent the forward ends 30, 34 of upper linkage bars 14, 16. However, depending on the load and positioning thereof on work surface 12, the user may wish to move forward brackets 46, 48 rearwardly along upper linkage bars 14, 16 towards support members 22, 24.

It will thus be appreciated there is provided a unique, multi-purpose utility table which may be quickly and easily continuously adjusted between horizontal and vertical positions to suit the needs of the user. While the invention has been shown and described with particular reference to a preferred embodiment thereof, certain changes and modifications may be made thereto without departing from the full spirit and scope of the invention as is defined by the claims which follow.

What is claimed is:

1. An adjustable table assembly comprising:

a) first and second, elongated support members each having first and second channels including respective first and second channel openings extending inwardly toward each other along opposite sides of substantially the entire longitudinal lengths of said first and second support members, and further including means for fixing said first and second support members in vertical and laterally spaced, parallel relationship to each other;

b) first and second upper linkage bars each having respective forward and rear ends;

c) first and second lower linkage bars each having respective forward and rear ends;

d) a substantially planar work surface of predetermined outline having top and bottom, opposite planar surfaces and parallel and spaced forward and rear edges, said first and second upper linkage bars attached to said bottom planar surface in laterally spaced, parallel relationship to each other and perpendicular to said forward and rear edges, said rear ends of said first and second upper linkage bars extending beyond said rear edge of said planar work surface;

e) first and second upper brackets each having first and second portions, said rear ends of said first and second upper linkage bars pivotally attached to said first portions of said first and second upper brackets, respectively, said second portions of said first and second upper brackets positioned in sliding, mating engagement with said first and second channels of said first and second support members, respectively;

f) first and second lower brackets each having first and second portions, said rear ends of said first and second lower linkage bars pivotally attached to said first portions of said first and second lower brackets, respectively, said second portions of said first and second lower brackets positioned in sliding, mating engagement with said first and second channels of said first and second support members, respectively, at positions below said first and second upper brackets on said first and second support members, respectively;

g) first and second forward brackets each having first and second portions, respectively, said forward ends of said first and second lower linkage bars being pivotally attached to said first portions of said first and second forward brackets, respectively; and h) means removably attaching said second portions of said first and second forward brackets to said first and second upper linkage bars in longitudinally sliding engagement therewith.

2. The invention according to claim 1 wherein said second portions of said first and second upper and lower brackets each include first and second walls lying in spaced, parallel planes thereby forming a rear slot therebetween, said first and second walls including respective first and second, inwardly facing wall surfaces, and further including first and second, diametrically opposite flanges longitudinally traversing said first and second, inwardly facing wall surfaces, respectively, in said rear slot, said first and second flanges positioned in said mating engagement with said first and second channels of said first and second support members, respectively.

3. The invention according to claim 2 wherein said first and second support members and said rear slots of said first and second upper and lower brackets are of I-shaped cross-section.

4. The invention according to claim 3 wherein said first and second support members include a rear, forward and middle wall, said rear and forward walls lying in spaced, parallel planes with said middle wall extending integrally and perpendicularly therebetween along substantially the entire lengths of said rear and forward walls, said first and second channels being located on either said of said middle wall between said rear and forward walls.

5. The invention according to claim 4 and further including means for selectively, longitudinally adjusting each of said first and second upper brackets on said first and second support members.

6. The invention according to claim 5 wherein said longitudinal adjusting means comprises:

a) a first plurality of longitudinally spaced bore holes extending completely through said middle walls of said first and second support members in directions parallel to said rear and forward walls thereof, respectively;

b) first and second, laterally aligned bore holes extending completely through said first and second walls, respectively, of each of said first and second upper and lower brackets in a direction perpendicular to said first and second walls and through said first and second flanges; and c) removable bolt means extending through predetermined, laterally aligned sets comprising said first and second bore holes in each one of said first and second upper and lower brackets, and a respective, predetermined one of said first plurality of bore holes in said first and second support members.

7. The invention according to claim 6 wherein said support member fixing means comprises means fixedly mounting said first and second support members to a substantially planar, vertical wall surface.

8. The invention according to claim 7 wherein said mounting means comprises:

a) a second plurality of longitudinally spaced bore holes in each of said first and second support members, said second plurality of bore holes extending completely through said rear, forward and middle walls in directions perpendicular to said rear and forward walls, each of said second plurality of bore holes being located between a longitudinally adjacent pair of said first plurality of bore holes; and b) a plurality of screw means for passing consecutively through said forward, middle and rear walls of a respective one of said second plurality of bore holes, and into said vertical wall surface thereby mounting said first and second support members to said vertical wall surface with said rear walls thereof lying flat against and in covering relation to said vertical wall surface.

9. The invention according to claim 2 wherein said first portions of said first and second upper and lower brackets each include third and fourth walls lying in spaced, parallel planes thereby forming a forward slot therebetween, said rear ends of said upper and lower linkage bars being located between said third and fourth walls in said rear slot of said first and second upper and lower brackets, respectively.

10. The invention according to claim 9 wherein said first and second walls are contiguous and coplanar with said third and fourth walls, respectively, of each of said first and second upper and lower brackets.

11. The invention according to claim 1 wherein said first and second forward brackets are of H-shaped cross-section having first and second walls lying in spaced, parallel planes and a middle wall extending perpendicularly therebetween thereby forming upper and lower slots on either side of said middle wall between said first and second walls, respectively.

12. The invention according to claim 11 and further including means for longitudinally selectively adjusting said first and second forward brackets on said first and second upper linkage bars, respectively.

13. The invention according to claim 12 wherein said longitudinal adjusting means comprises:

a) a plurality of longitudinally spaced bore holes laterally extending through each of said first and second upper linkage bars;

b) first and second, laterally aligned bore holes extending perpendicularly through said first and second walls, respectively, at said upper slot; and c) removable bolt means extending through predetermined, laterally aligned sets comprising said first and second bore holes in each of said first and second forward brackets, and a respective one of said plurality of bore holes in said first and second upper linkage bars.

* * * * *